US007128703B2

(12) United States Patent
Oetlinger

(10) Patent No.: US 7,128,703 B2
(45) Date of Patent: Oct. 31, 2006

(54) FLUSH MOUNTED PRESSER ASSEMBLY

(75) Inventor: Frank E. Oetlinger, Grafton, WI (US)

(73) Assignee: Blanking Systems, Inc., Grafton, WI (US)

( * ) Notice: Subject to any disclaimer, the term of this patent is extended or adjusted under 35 U.S.C. 154(b) by 0 days.

(21) Appl. No.: 10/160,856

(22) Filed: Jun. 3, 2002

(65) Prior Publication Data

US 2003/0116036 A1 Jun. 26, 2003

Related U.S. Application Data

(63) Continuation-in-part of application No. 10/035,732, filed on Dec. 26, 2001.

(51) Int. Cl.
*B31B 3/74* (2006.01)

(52) U.S. Cl. ..... 493/83; 493/468; 493/478; 493/373; 225/103; 225/104; 225/105

(58) Field of Classification Search ..... 100/266, 100/265, 283; 493/468, 467, 473, 475, 478, 493/480, 373, 340, 143, 83, 82; 225/103–105; 254/122, 124, 126
See application file for complete search history.

(56) References Cited

U.S. PATENT DOCUMENTS

| | | | | |
|---|---|---|---|---|
| 1,071,959 | A | 9/1913 | Schoenfeld | |
| 1,404,239 | A | 1/1922 | Seybold | |
| 1,911,742 | A | 5/1933 | Berry | |
| 2,413,999 | A | 1/1947 | Shaner | 164/87 |
| 2,558,456 | A | 6/1951 | Palmer | 93/55.1 |
| 2,655,081 | A | 10/1953 | Burger | 93/37 |
| 2,771,292 | A | 11/1956 | Emerson | 217/50 |
| 3,049,060 | A | 8/1962 | Vahle | 93/37 |
| 3,153,755 | A | 10/1964 | Nestler et al. | 93/12 |
| 3,198,091 | A | 8/1965 | Fahey | 93/37 |
| 3,794,228 | A | 2/1974 | Colwill | 225/93 |
| 3,952,633 | A | 4/1976 | Nakai | 93/37 |
| 3,952,634 | A | 4/1976 | Rollins et al. | 93/49 |
| 3,964,655 | A | 6/1976 | Kotaro | 225/97 |
| 4,171,081 | A | 10/1979 | Vossen et al. | 225/97 |
| 4,243,166 | A | 1/1981 | Vossen et al. | 225/1 |
| 4,248,370 | A | 2/1981 | Schroter | 225/97 |

(Continued)

FOREIGN PATENT DOCUMENTS

| | | |
|---|---|---|
| CA | 593131 | 2/1960 |

(Continued)

*Primary Examiner*—Derris H. Banks
*Assistant Examiner*—Shelley Self
(74) *Attorney, Agent, or Firm*—Boyle Fredrickson Newholm Stein & Gratz S.C.

(57) ABSTRACT

A flush mounted presser assembly for a die cutting machine. The presser assembly includes a support member having an upper surface which defines a substantially horizontal plane, a presser movable vertically in a plane perpendicular to the horizontal plane of the support member between a first extended position spaced from the support member beneath the horizontal plane and a second retracted position also beneath the horizontal plane of the support member, and a mounting arrangement for mounting the presser to the support member wherein the mounting arrangement is disposed flush with or below the horizontal plane of the support member so that none of its components extend or project above the horizontal plane of the support member. The mounting arrangement comprises a base mounted on the support, a linkage assembly interconnecting the base and presser, and a spring for biasing the linkage assembly and presser toward its first extended position away from the support member.

20 Claims, 9 Drawing Sheets

U.S. PATENT DOCUMENTS

| | | | | | |
|---|---|---|---|---|---|
| 4,488,466 | A | | 12/1984 | Jones | 83/175 |
| 4,493,234 | A | | 1/1985 | Ziegler | 83/175 |
| 4,500,306 | A | | 2/1985 | Nowacki | 493/92 |
| 4,767,482 | A | | 8/1988 | Diez | 156/163 |
| 5,222,717 | A | * | 6/1993 | Traficant | 254/122 |
| 5,529,565 | A | | 6/1996 | Oetlinger | 493/468 |
| 5,599,269 | A | | 2/1997 | Oetlinger | 493/468 |
| 5,766,123 | A | | 6/1998 | Oetlinger | 493/468 |
| 5,971,378 | A | * | 10/1999 | Sweeney | 269/6 |
| 6,062,638 | A | * | 5/2000 | Ferguson | 297/4 |
| 2002/0160898 | A1 | * | 10/2002 | Myers et al. | 493/373 |

FOREIGN PATENT DOCUMENTS

| | | |
|---|---|---|
| CH | A53131 | 11/1977 |
| DE | 419900 | 10/1925 |
| DE | A2022951 | 1/1971 |
| DE | A2825631 | 1/1979 |
| DE | A3033648 | 4/1982 |
| EP | A0391299 | 10/1990 |
| FR | A2682633 | 4/1993 |
| SE | CH393061 | 5/1965 |

* cited by examiner

FLUSH MOUNTED PRESSER ASSEMBLY

CROSS REFERENCE TO RELATED APPLICATION

This application is a continuation-in-part of application Ser. No. 10/035,732 filed Dec. 26, 2001.

BACKGROUND OF THE INVENTION

The present invention relates to die cutting machines for making carton blanks, and more particularly to a presser assembly for supporting carton blanking scrap during a blanking operation in a die cutting machine.

In the manufacture of cartons, small sheets of paper material having specific profiles are cut out of larger sheets of paper material. These smaller sheets are known as carton blanks which, in turn, are formed into cartons and/or boxes. The blanks are formed during a process known as a blanking operation in a die cutting machine.

In a die cutting machine, the blanks are cut, but not removed from a large sheet of paper material. After the blanks have been cut, the sheet is moved downstream in the die cutting machine to a blanking station where the sheet is positioned over a frame for support. The frame includes large openings which correspond in size, in shape and in position to the profile of the carton blank previously cut. Below the frame is a mechanism for stacking the carton blanks.

At the blanking station, an upper tool is used in combination with the lower tool or frame to knock the carton blanks from the sheet of paper material while holding the scrap material that surrounds the blanks. The upper tool has a support board that moves vertically up and down in the die cutting machine, and the support board typically has a plurality of stand-offs depending therefrom that hold pushers spaced beneath the board which in turn are used to push the carton blanks from the sheet through the lower tool or frame. A plurality of presser assemblies are also mounted in the support board and depend therefrom to hold the scrap material against the lower tool or frame during the blanking operation so that the blanks may be pushed from the sheet. A presser assembly typically includes a presser rail which is biased downwardly away from the support board by a spring so that the rail is positioned slightly below the pushers. As the upper tool is lowered, the presser rail engages the sheet of paper material first such that a scrap portion of the large sheet of material is secured between the presser rail and the frame. The upper tool then continues to be lowered such that the pushers engage the carton blanks and knock the blanks out of the sheet of material. The carton blank then falls into a stacking mechanism below the frame where the blanks are stacked for further processing.

In order to securely hold the carton blank scrap, the present day presser rails are interconnected to the support board by a plurality of guide cylinders. Each guide cylinder biases the presser rail downwardly away from the support board, and are mounted to the support board such that their upper ends project upwardly from the board. However, it is desirable to eliminate any components projecting above the support board and instead provide flush mounted presser assemblies for at least two reasons. First, for tool storage purposes an upper tool having flush mounted pressers takes up less space. This is particularly advantageous in locations where storage space is at a premium. Secondly, many die cutting machines are built in such a manner that the upper tool slides into the blanking station of the machine. Any component projecting upwardly of the support board would interfere with such sliding action. Therefore, only flush mounted presser assemblies can be used with such systems.

SUMMARY OF THE INVENTION

It is an object of the present invention to provide a so-called "flush mounted" presser assembly wherein none of the components of the presser assembly project above the supporting tool.

It is another object of the present invention to provide a presser assembly having a presser rail which securely holds carton blanking scrap during a blanking operation.

It is still another object of the present invention to provide a presser assembly having a presser rail and interconnecting linkage which is durable and maintains its shape over an extended period of time.

Yet another object of the invention is to provide a presser assembly which is easy to assemble, easy to mount to standard blanking operation machinery, and relatively inexpensive.

In order to accomplish the above objects, the present invention provides a flush mounted presser assembly for a die cutting machine. The presser assembly includes a support member having an upper surface which defines a substantially horizontal plane, a presser movable vertically in a plane perpendicular to the horizontal plane of the support member between a first extended position spaced from the support member beneath the horizontal plane and a second retracted position also beneath the horizontal plane of the support member, and mounting means for mounting the presser to the support member wherein the mounting means is disposed flush with or below the horizontal plane of the support member so that the mounting means does not extend or project above the horizontal plane of the support member. The mounting means preferably comprises a base mounted on the support, a linkage assembly interconnecting the base and presser, and biasing means for biasing the linkage assembly and presser toward its first extended position away from the support member.

In one embodiment, the linkage assembly comprises an arm interconnecting the base and presser and having an upper end mounted to the base that simultaneously pivots and moves horizontally with respect to the support as the presser moves between its extended and retracted positions, and a lower end pivotally mounted to the presser, and a link interconnecting the base and arm and having an upper end pivotally mounted to the base and a lower end pivotally mounted to the arm. In this embodiment, the presser is connected via the linkage assembly to the base at a single pivot point, i.e. the lower end of the arm. In addition, the presser moves vertically in a plane perpendicular to the horizontal plane of the support member. This vertical up and down movement is accomplished by disposing the pivotal mounting of the lower end of the link at the midpoint between the upper and lower pivotal mountings of the arm such that the pivotal mounting of the lower end of the link is located in a plane extending through the upper and lower pivotal mountings of the arm and the distances between the pivotal mounting of the lower end of the link and (a) the pivoting mounting of the upper end of the link and (b) the pivotal mounting of the upper end of the arm, and (c) the pivotal mounting of the lower end of the arm, are all equal. As a result, the linkage assembly causes the presser to move vertically straight up and down with respect to the support.

In an alternate embodiment, the presser is mounted via two pivots through the linkage assembly to the base. In this embodiment, the linkage assembly comprises an arm interconnecting the base and presser and having a lower end mounted to the presser that simultaneously pivots and moves horizontally with respect to the support as the presser moves between its extended and retracted positions, and an upper end pivotally mounted to the base, and a link interconnecting the arm and presser and having an upper end pivotally mounted to the arm and a lower end pivotally mounted to the presser. Again, in order to provide vertical up and down movement for the presser, the pivotal mounting of the upper end of the link is located at the midpoint between the upper and lower pivot mountings of the arm, and the pivot mounting of the upper end of the link is also located in a plane extending through the upper and lower pivotal mountings of the arm. In addition, the distances between the pivotal mounting of the upper end of the link and (a) the pivotal mounting of the lower end of the link and (b) the pivotal mounting of the upper end of the arm, and (c) the pivotal mounting of the lower end of the arm, are all equal. The linkage assembly of this second embodiment thus insures vertical straight up and down movement for the presser.

In yet another embodiment, the linkage assembly provides a scissor-like action. In other words, not only does the arm extend between the base and presser but also the link extends between the base and presser. The link is pivotally mounted to the arm at the midpoint between the upper and lower pivot mountings of the arm and at its own midpoint, and the upper end of the link is pivotally connected to the base while the lower end of the link pivots and slides horizontally within the presser to insure the presser moves vertically as it extends and retracts.

The above linkage assemblies may be used with elongated straight pressers where two spaced apart in-line linkage assemblies might be used, shorter but still straight pressers and/or spot pressers where only one linkage assembly is used, or bendable pressers having angled segments along its length. Bendable pressers may be used when unique or custom presser shapes are desired which may require the presser to have numerous bends at different angles formed along its length.

Other advantages and features of the invention will be readily apparent from the description of the preferred embodiments, the drawings and the claims.

DETAILED DESCRIPTION OF THE PREFERRED EMBODIMENTS

Figure 1:
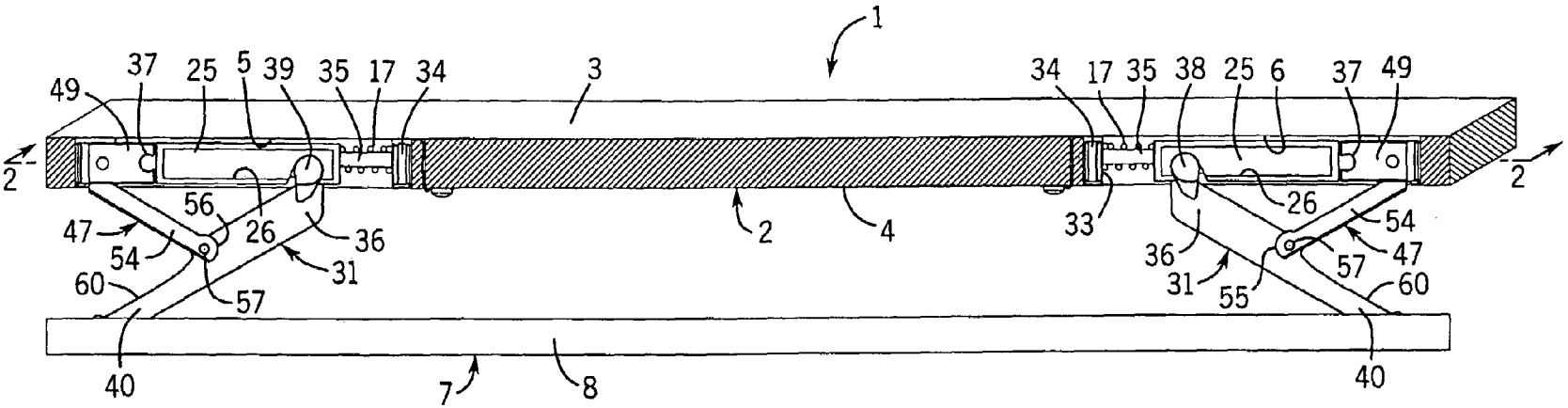
FIG. 1 is a perspective view partially in section of a flush mounted presser assembly in accordance with the present invention shown in its extended position.

Referring now to the drawings, FIGS. 1–5 illustrate a presser assembly generally designated by the numeral 1 which is used in a die cutting machine for converting or processing a sheet of paper material into a carton blank. These machines are well known in the art and are used to cut one or several blanks into each sheet of paper material which, after folding and gluing, may be formed into cartons or boxes. As is conventional, the sheets of paper material within the machine are carried through various sequences of printing, cutting, embossing, creasing, waste stripping and/or blanking stations.

The die cutting machine usually is formed by a series of stations with the first station being a starting position or input station in which the sheets, which may be preprinted if desired, are taken one by one from the top of a stack to a feed table where they are placed in position against frontal and side guides. The sheet can then be grasped by a gripper bar and lead downstream or in the machine direction into subsequent processing stations. Typically, the sheet is first conveyed into a cutting station where the carton or box blanks of a desired size and profile are cut into the sheet. These blanks are held to the sheet by knicks which are arranged along the cut edges of the blanks. This cutting station is usually comprised of upper and lower tools, one of which is provided with a plurality of line-shaped straight and curved die cutting blades. If desired, the cutting station may be proceeded by a printing station, or as noted above, the sheets may be preprinted. After cutting, the sheet is then lead to a stripping station where the waste, i.e. the unused scrap between the various blanks, are grasped by upper and lower pins in order to be lead downward into a waste container. The sheet is then fed to a blanking station where the sheet is positioned over a frame for support. The frame includes large openings which correspond in size, in shape and in position to the profile of the blank previously cut. An upper blanking tool having one or more presser assemblies mounted thereto then moves vertically downwardly in the die cutting machine to secure the scrap portions against the frame and then as the tool continues to move downwardly, the fasten points or knicks between the blanks and the sheet are broken by pushers so that each of the blanks are released and falls below the frame where the blanks are stacked for further processing. Finally, the residual or remaining portion of the sheet is carried into a delivery or exit station where it is released by the gripper bar as waste material.

The presser assembly 1 of the present invention is of the so-called "flush mounted" type, and as such, none of its components extend above the upper blanking tool. As shown in FIGS. 1–5, the presser assembly 1 is secured to a flat, plate-like support member or board 2 typically composed of a wood material such as plywood or the like. Support member 2 has a planer upper surface 3 and a planer lower surface 4 with the upper surface defining a substantially horizontal plane. As shown best in FIG. 5, support member 2 includes a pair of aligned longitudinal slots 5 and 6 formed therein for receiving the components of the presser mounting arrangement which will hereinafter be described. The dimensions of support member 2 can vary depending upon the dimensions of the sheet of paper material with which it is used, and the number of as well as the profile of the carton blank to be produced, as is well known to those skilled in the art.

Figure 5:
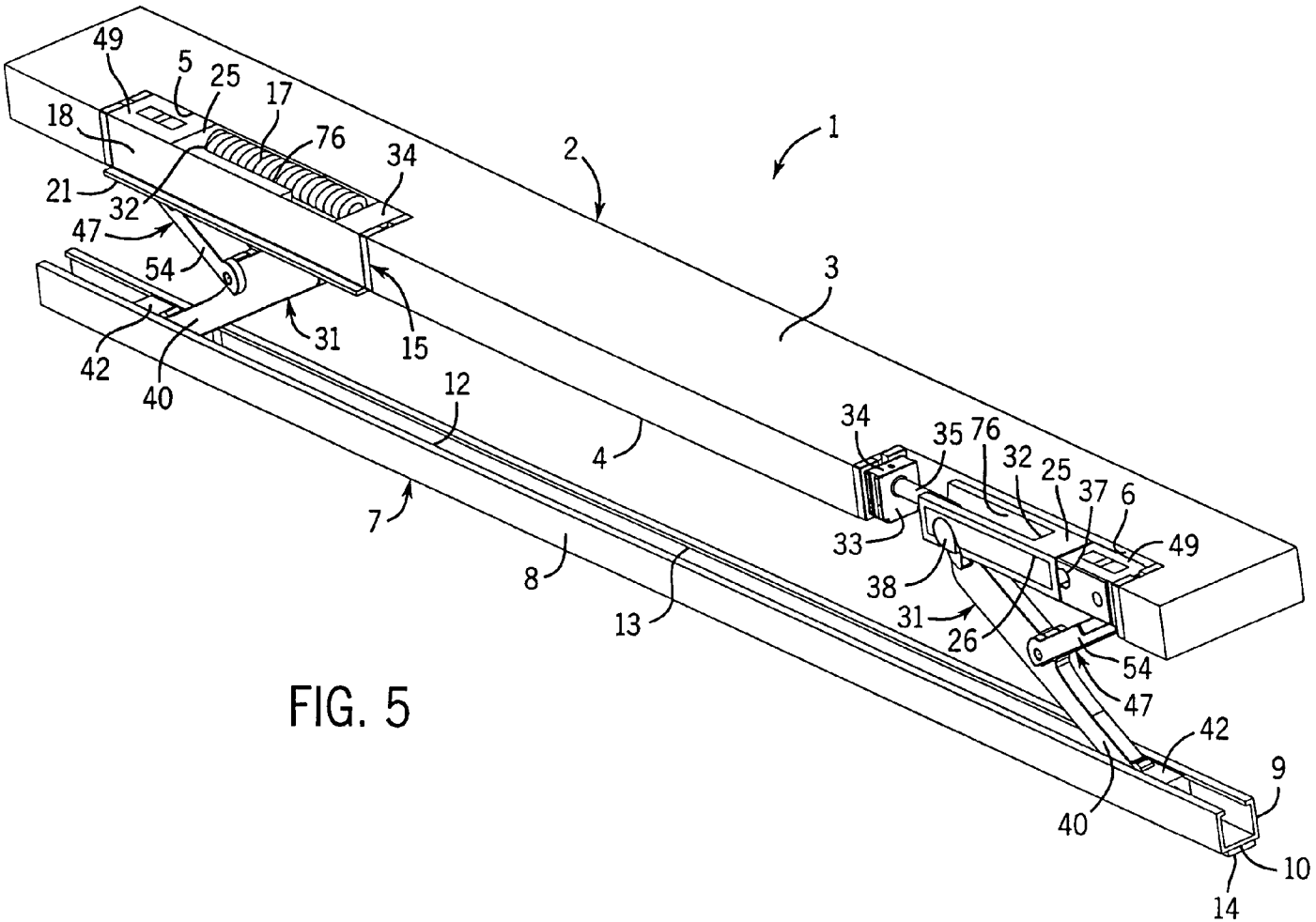
FIG. 5 is a perspective view of the presser assembly of FIG. 1 with some parts broken away and other parts shown in cross-section to illustrate the components of the presser assembly.
Figure 6:
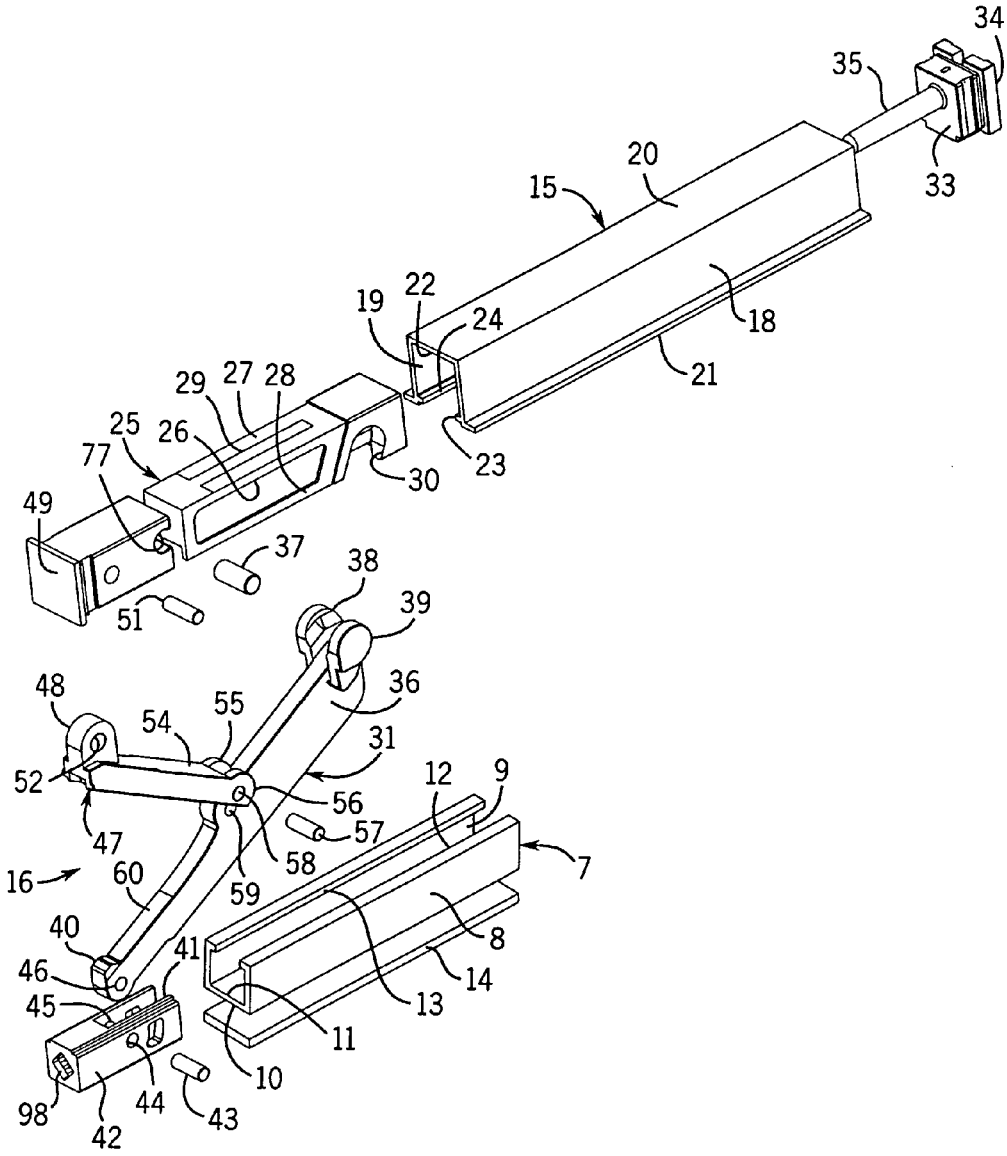
FIG. 6 is a perspective exploded view illustrating a presser mounting arrangement.
Figure 11:
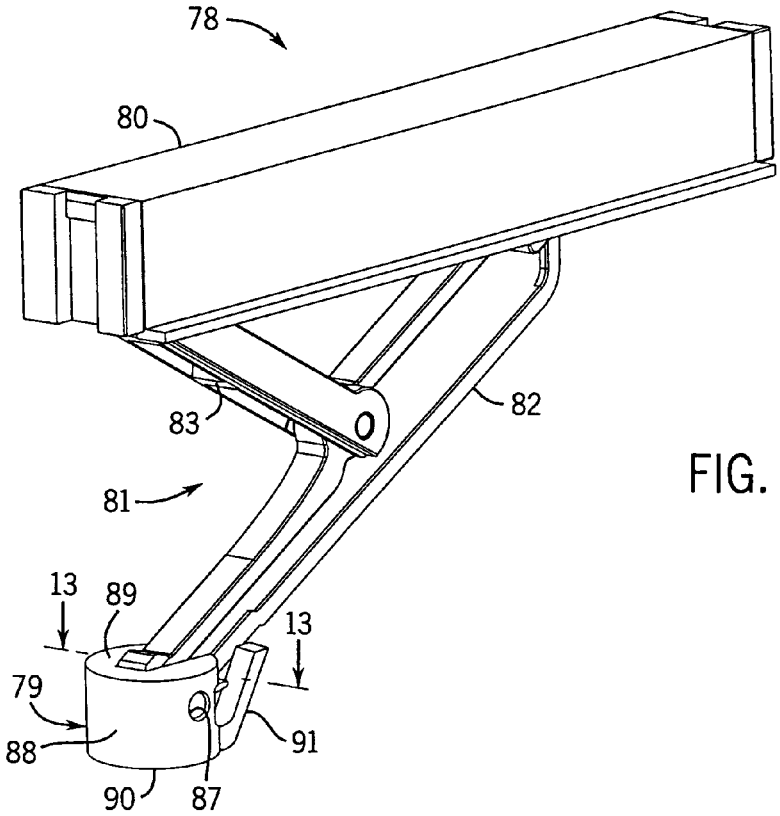
FIG. 11 is a front perspective view of a third embodiment of the flush mounted presser assembly illustrating a spot presser.
Figure 12:
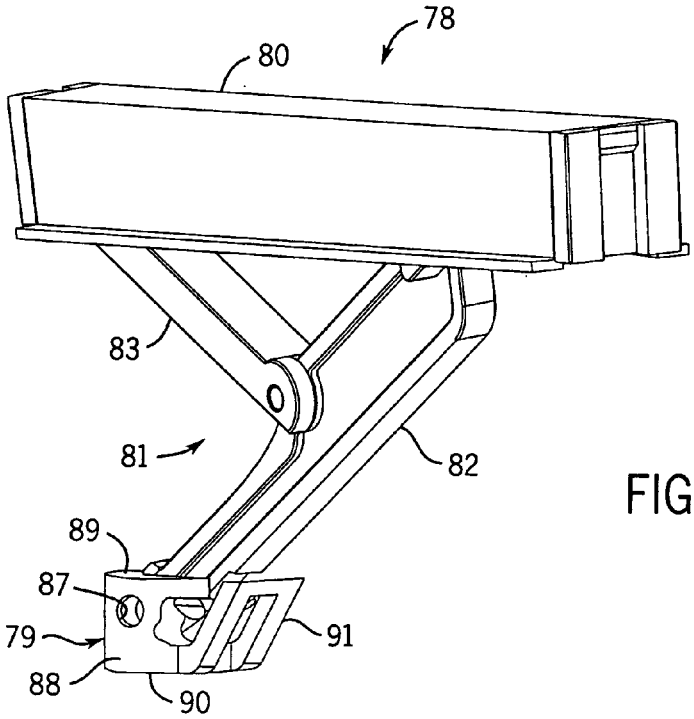
FIG. 12 is a rear perspective view of the presser assembly of FIG. 11.
Figure 13:
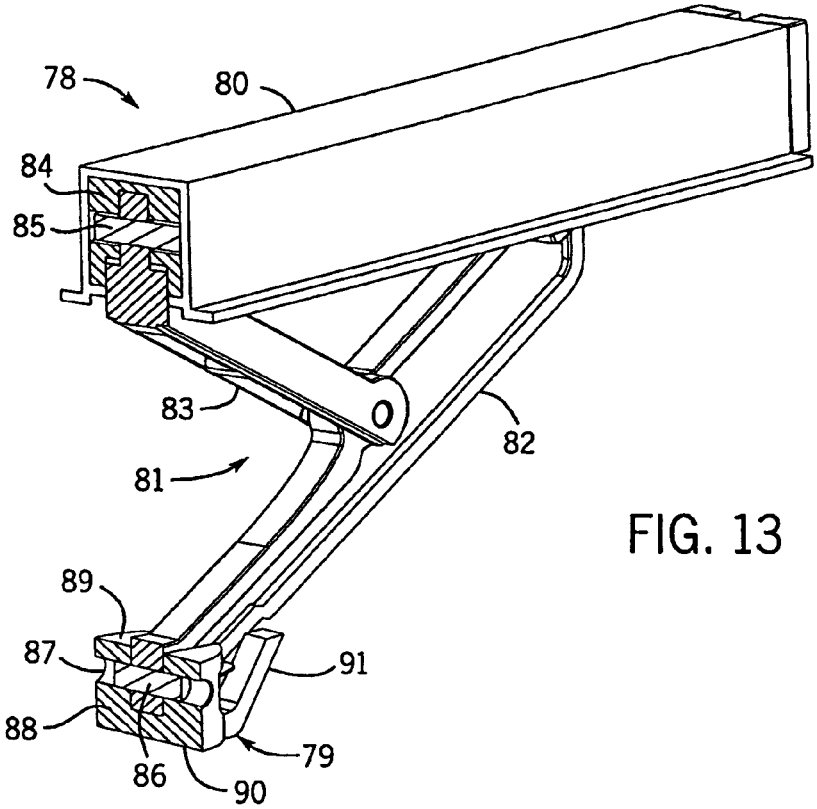
FIG. 13 is a cross-sectional front view similar to FIG. 11 taken along the plane of the lines 13—13 in FIG. 11.

Presser assembly 1 also includes a presser 7 moveable vertically in a plane perpendicular to the horizontal plane of support member 2. Presser 7 moves between a first extended position shown in FIG. 1 wherein it is spaced from support member 2 beneath the horizontal plane defined by upper surface 3, and a second retracted position illustrated in FIG. 3 wherein it is positioned closely adjacent to lower surface 4 of support member 2 but yet still beneath the horizontal plane defined by upper surface 3. As illustrated best in FIGS. 5 and 6, presser 7 is in the form of an elongated, channel-shaped rail member having opposite sidewalls 8 and 9 interconnected by a bottom wall 10 to define an elongated, longitudinally extending channel 11. Presser 7 extends longitudinally parallel to the horizontal plane defined by upper surface 3 of support member 2, and further includes a pair of opposite flanges 12 and 13 extending inwardly toward each other from the top edges of sidewalls 8 and 9 respectively. Also, as best shown in FIG. 6, presser 7 includes a longitudinally extending strip 14 of rubber, foamed polyurethane, or the like which is adhesively secured to the outer surface of bottom wall 10. This strip 14 engages the top surface of the sheet of paper material during the blanking operation and is used to hold the paper material against the frame positioned beneath the sheet of paper material. As is well known in the art, presser 7 can take various shapes depending upon the shape of the scrap from which the carton blank is being stripped. Thus, the specific dimensions illustrated in the drawings for presser 7 are for illustration purposes only, as the length, width, and profile of presser 7 may vary as is well known to those skilled in the art. In particular, presser 7 may be in the form of a short rail (shown in FIG. 6) for stripping a relatively short piece of waste from the carton blank or may take the form of a finger-like or spot member which extends vertically in the plane which is perpendicular to the horizontal plane defined by upper surface 3. A finger-like or spot presser might be used in a situation where a relatively small scrap piece must be supported and held fast during the stripping operation performed by the blanking tool. It should be particularly noted that if either a short rail or a finger-like or spot member is used as a presser, only a single mounting arrangement is necessary for mounting such a presser to support member 2 rather than the dual arrangement illustrated in FIGS. 1–5. Reference is made to FIGS. 11–13 which illustrate a spot presser as will hereinafter be described.

The flush mounted presser assembly 1 also includes mounting means for mounting presser 7 to support member 2. As noted in FIGS. 1–5, none of the components of the mounting arrangement extend or project above the horizontal plane defined by upper surface 3 of support member 2. All of the components for the mounting arrangement are disposed either flush with or below upper surface 3, and thus presser assembly 1 is referred to as a "flush mounted" presser assembly. As illustrated in the drawings, there are two mounting arrangements disposed at opposite ends of presser 7 for interconnecting presser 7 to support 2. Both mounting arrangements are identical and therefore only one will be hereinafter described, but the numbers hereinafter used are applicable to both arrangements. More specifically, the mounting arrangement includes a base 15 mounted within slots 5 and 6 formed in support 2, a linkage assembly generally designated by the numeral 16 interconnecting base 15 and presser 7, and a coil spring 17 for biasing the linkage assembly 16 and presser 7 toward its first extended position illustrated in FIG. 1.

Figure 2:
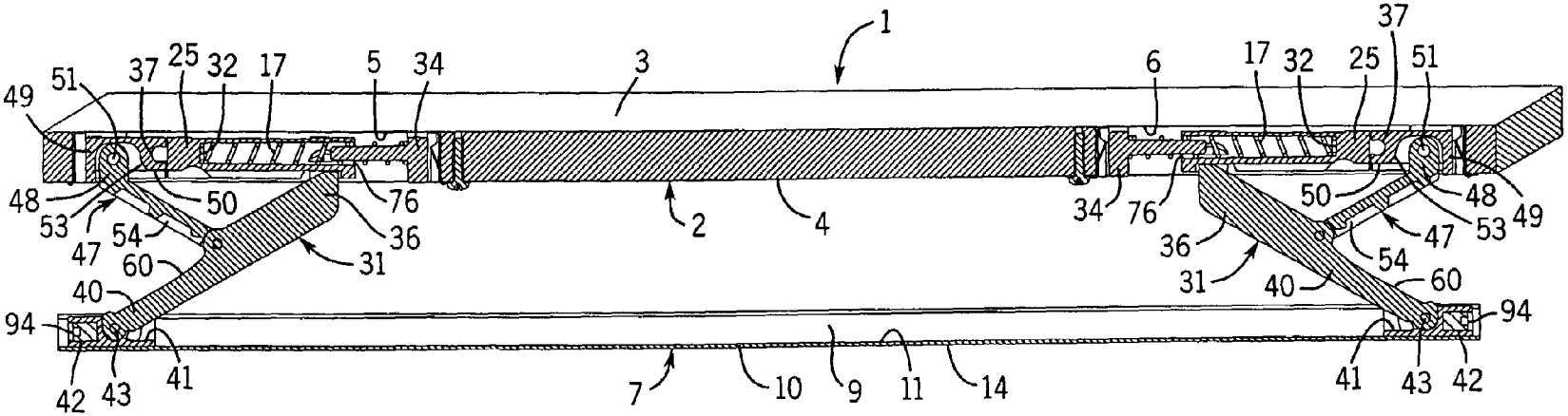
FIG. 2 is a perspective view similar to FIG. 1 of the presser assembly shown in longitudinal cross-section along the lines 2—2 in FIG. 1.
Figure 3:
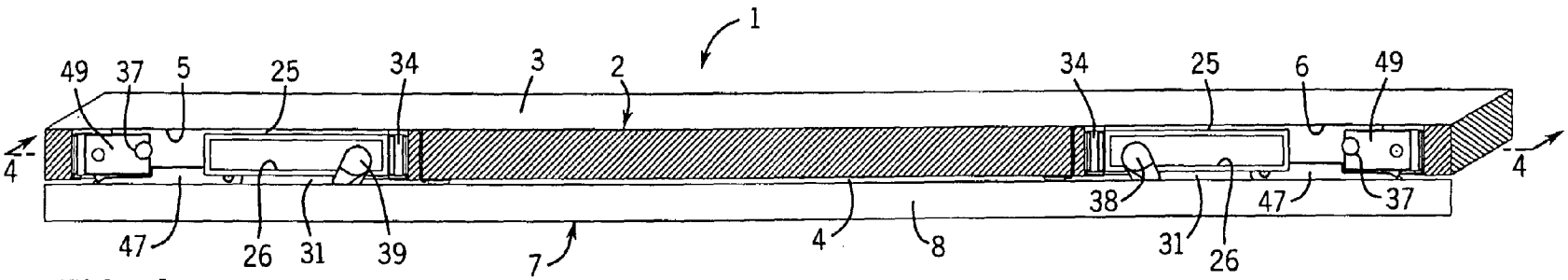
FIG. 3 is a perspective view of the presser assembly shown in its retracted position.
Figure 4:
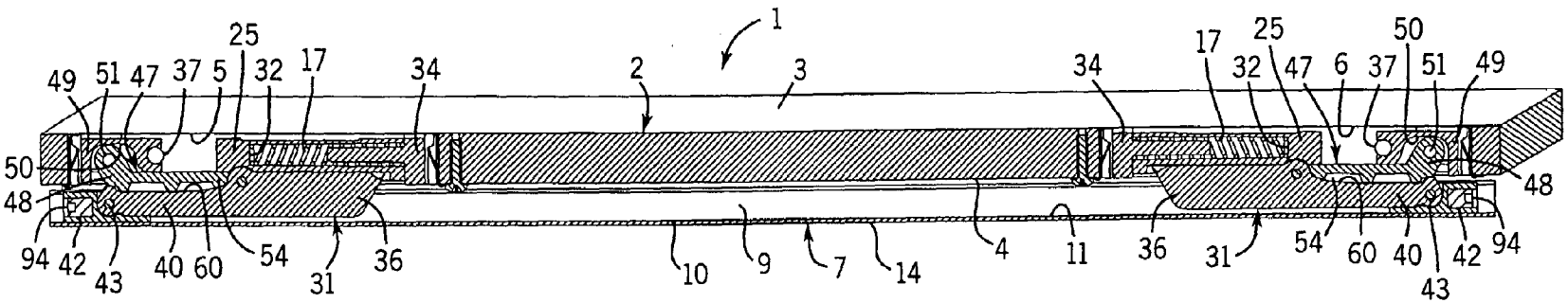
FIG. 4 is a view similar to FIG. 3 showing the presser assembly in longitudinal cross-section along the lines 4—4 in FIG. 3.

As shown best in FIG. 6, base 15 is dimensioned to correspond with the dimensions of slot 6 and is in the form of an elongated channel-shaped member. Base 15 includes a pair of opposite sidewalls 18 and 19 interconnected at their top edges by a top wall 20. Top wall 20 is disposed flush with upper surface 3 of support member 2. The bottom edges of sidewalls 18 and 19 each include an outwardly extending flange 21 (only one of which is shown in FIGS. 5 and 6). When base 15 is located within slots 5 and 6 of support member 2, flanges 21 extend over the lower edges thereof and engage lower surface 4 to properly position base 15 within slot 6 so that top wall 20 is flush with upper surface 3. Flanges 21 also are used to secure base 15 within slot 6 via fasteners or screws (not shown) which extend therethrough into lower surface 4 of support member 2. Walls 18–20 define a longitudinally extending and downwardly opening channel 22 which is used to receive some of the components of linkage assembly 16, as will hereinafter be described. Also, as best seen in FIG. 6, a pair of inwardly directed rails 23 and 24 are disposed along the inner surfaces of sidewalls 18 and 19 and project inwardly therefrom to form a railway for slideably receiving a slider 25 as part of linkage assembly 16. As shown best in FIGS. 2 and 4, slider 25 moves in a reciprocal pattern horizontally within base 15 so that when presser 7 is in its extended position as illustrated in FIG. 2, slider 25 is within the right side of base 15, and when presser 7 is in its retracted position as illustrated in FIG. 4, slider 25 is to the left within base 15. As seen best in FIG. 6, the outer surface of slider 25 has a rectangular cutout 26 and a U-shaped cutout 27 formed therein which minimize the friction developed between the sides 28 and top 29 respectively of slider 25 and the corresponding inner surfaces of base 15. As seen best in FIGS. 2, 4 and 5, slider 25 has a longitudinally extended bore 76 formed therein for receiving spring 17 therein. Slider 25 also includes a semicircular opening 30 formed transversely therethrough for pivotally receiving the upper end of an arm 31 therein, as will hereinafter be described.

Spring 17 is a coil spring disposed longitudinally within bore 76 of slider 25 and acts against slider 25 by having one of its ends bearing against end surface 32 of bore 76, and its other end bearing against a corresponding flat surface 33 of an abutment member 34. Abutment member 34 is mounted at the inner end of slot 6, and includes a guide rod 35 projecting therefrom along an axis which is parallel to the horizontal plane defined by upper surface 3 of support member 2. Guide rod 35 is used to properly position spring 17 and to guide spring 17 between its extended position which forces slider 25 to the left in FIG. 6 and presser 7 to its extended position, and a compressed position as shown in FIG. 4 wherein presser 7 is in its retracted position.

In addition to slider 25, linkage assembly 16 includes arm 31 which interconnects base 15 and presser 7. Arm 31 has an upper end 36 that simultaneously pivots and moves horizontally with respect to support member 2 as presser 7 moves between its extended and retracted positions. As shown best in FIG. 6, the pivotal connection of upper end 36 is provided by opening 30 in slider 25, and a pair of spaced apart ears 38 and 39 projecting from upper end 36 of arm 31. When positioned within opening 30, the outer circumferential surfaces of ears 38 and 39 bear against and rotate relative to the inner circumferential surfaces of opening 30. Also, when slider 25 is positioned within base 15, ears 38 and 39 are captured between walls 18 and 19 so that the upper end 36 of arm 31 is securely fastened to slider 25 and yet is still allowed to pivot and move horizontally as presser 7 moves up and down. Arm 31 also includes a lower end 40 which is pivotally mounted to presser 7. As shown best in FIG. 6, the lower end 40 of arm 31 is received within a slot 41 formed in a mounting block 42, and the pivotal connection of lower end 40 is provided by a pin 43 extending through aligned openings 44 and 45 in block 42 and an opening 46 in lower end 40 of arm 31. Mounting block 42 is secured within channel 11 of presser 7. Pin 43 is captured between sidewalls 8 and 9 to secure it in position. As shown, the dimensions of mounting block 42 substantially correspond to channel 11 and slot 41 opens upwardly to correspond with the upwardly channel 11 so as to provide sufficient room for the lower end 36 of arm 31 to rotate without interference from block 42. Mounting block 42 is preferably composed of rubber or polyurethane, and is secured within channel 11 of presser 7 by a square metal insert 94 received within a correspondingly square-shaped longitudinal bore 98. Insert 94 is initially slid into bore 98 and then rotated 45° to expand the urethane or rubber material to frictionally secure block 42 within channel 11.

Linkage assembly 16 also includes a link 47 interconnecting base 15 and arm 31. Link 47 has an upper end in the form of a projecting boss 48 which is pivotally mounted to base 15 by means of a mounting block 49 attached to base 15 within channel 22. Block 49 has a rubber or foamed polyurethane cylindrically shaped bumper or dampener 37 received within a semicircular opening 77 formed in the front face thereof. Bumper 37 acts to cushion the blow or force applied against block 49 when slider 25 moves against it as presser 7 returns to its fully extended position. Block 49 also has a slot 50 (best shown in FIGS. 2 and 4) for receiving boss 48. The pivotal connection of link 47 to block 49 is provided by a pin 51 extending through an opening 52 in boss 48 and captured within block 49. As shown best in FIGS. 2 and 4, slot 50 includes a beveled edge 53 which provides sufficient clearance to enable link 47 to rotate from the position shown in FIG. 2 where presser 7 is in its extended position to the position shown in FIG. 4 where the presser 7 is shown in its retracted position. Link 47 also has a lower end 54 which is pivotally mounted to arm 31. The pivotal connection of lower end 54 is provided by a pair of ears 55 and 56 integrally projecting from link 47 which straddle the top edge of arm 31 so that a pin 57 may extend through aligned openings 58 (only one of which is shown) in ears 55 and 56 and opening 59 in arm 31. Arm 31 also includes a cutout 60 which results in the thickness of arm 31 at its lower end to be approximately one-half the thickness of arm 31 at its upper end. Cutout 60 enables link 47 to collapse or nest against lower end 40 of arm 31 when presser 7 is in its fully retracted position, as will hereinafter be described. As shown best in FIG. 6, the pivotal connection of the lower end 54 of link 47 is located at the midpoint between the pivotal connection at the upper end 36 of arm 31 and the pivotal connection of the lower end 40 of arm 31. In addition, the pivotal mounting of the lower end 54 of link 47 is located in a plane extending through the upper and lower pivotal mountings of arm 31. Further, the distance between the pivotal mounting of the lower end 54 of link 47 and the pivotal mounting of the upper end 48 of link 47, as well as the distance from the pivotal mounting of the lower end of link 47 to the pivotal mounting of the upper end 36 of arm 31 and the distance to the pivotal mounting of the lower end 40 of arm 31, are all equal. As a result, pin 43 (and thus presser 7 also) moves vertically in a plane perpendicular to the horizontal plane defined by upper surface 3 of support member 2. In other words, pin 43 and presser 7 move straight up and down with respect to support member 2, and do not move in an arcuate path.

In operation, presser assembly 1 initially is disposed with presser 7 in its fully extended position as shown in FIG. 2, and the blanking tool above the sheet of paper material. As the blanking tool is lowered in the blanking station, presser 7 engages the upper surface of the sheet of paper material and holds it against a frame located below the sheet. The blanking tool then continues downwardly to knock out the carton blank from the sheet, and presser 7 continues to retract and may move to a position where presser 7 is in its fully retracted position as shown in FIG. 4. In its fully retracted position, arm 31 is located within channel 11 of presser 7 and link 47 extends parallel thereto and rests against the cutout portion 60 of arm 31. At the same time, the upper surface of presser 7 defined by flanges 12 and 13 engage lower surface 4 of support member 2. In addition, slider 25 has moved from a position abutting against bumper 37 of mounting block 49 (shown in FIG. 2) to a position spaced from block 49 and abutting against member 34 (shown in FIG. 4). As the blanking tool is moved back upwardly to its initial starting position, spring 17 forces slider 25 back against bumper 37 of mounting block 49 and moves presser 7 downwardly to its extended position as shown in FIG. 2.

Referring now to FIGS. 7–10, there is illustrated a second embodiment of the present invention. In this second embodiment, the presser assembly designated by the numeral 61 is generally similar to presser assembly 1 except that the mounting arrangement is reversed from that described with respect to the first embodiment. In other words, presser assembly 61 includes a support member 62 substantially identical to support member 2 having an upper surface 63 defining a horizontal plane and a lower surface 64. Support member 62 also includes a pair of aligned slots 65 formed therein, but in this embodiment slots 65 are used to receive the arm of the linkage assembly as will hereinafter be described rather than the base 15 as in the first embodiment.

Figure 9:
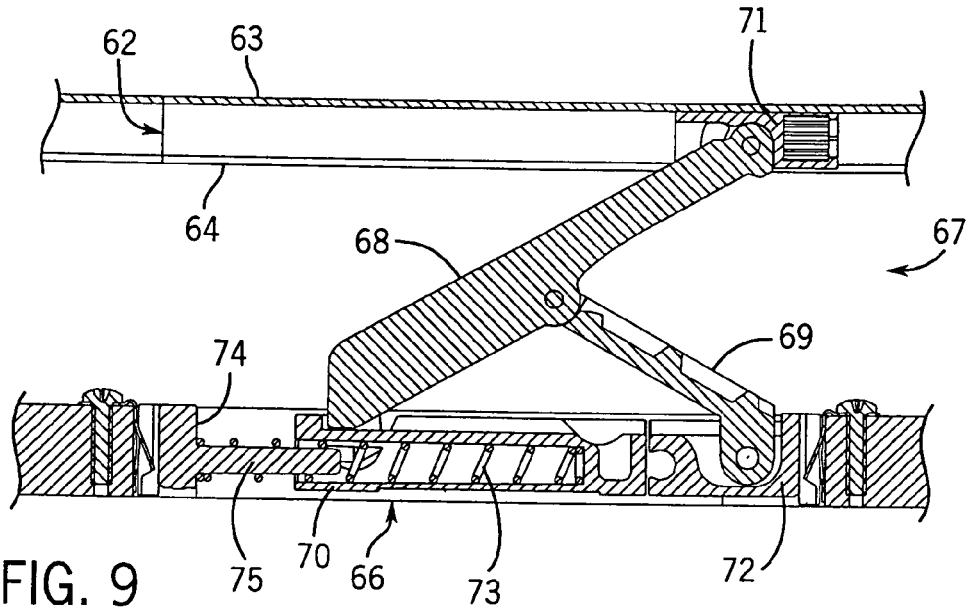
FIG. 9 is an enlarged cross-sectional view schematically illustrating the components of the presser mounting arrangement for the presser assembly of FIG. 7 with the presser shown in its extended position.
Figure 10:
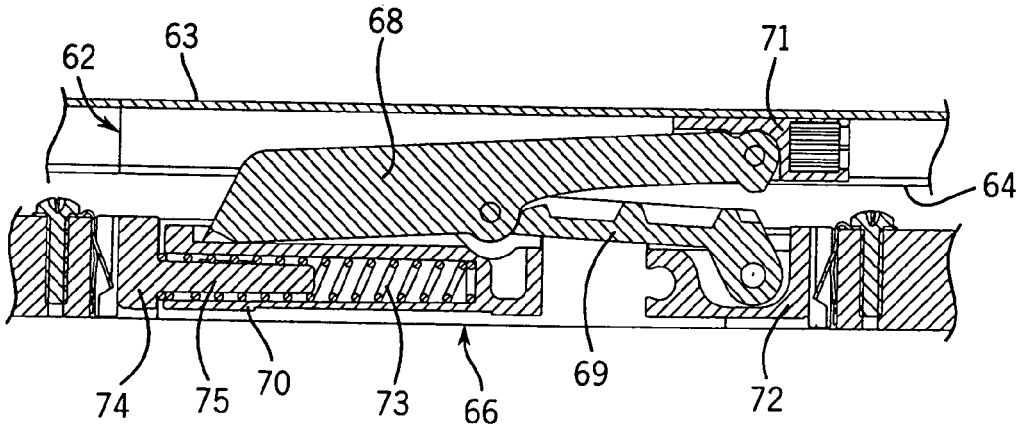
FIG. 10 is a cross-sectional view similar to FIG. 9 schematically illustrating the presser in its retracted position.

Presser 66 in the second embodiment is identical to presser 7 of the first embodiment. However, as shown in FIGS. 9 and 10, the mounting arrangement for mounting presser 66 to support member 62, although substantially similar to that described with respect to presser assembly 1, is the reverse thereof. In other words, the mounting arrangement includes a linkage assembly 67 having an arm 68, a link 69 and a slider 70 being slideably received within presser 66. Thus, as illustrated best in FIGS. 9 and 10, the lower end of arm 68 is pivotally mounted to slider 70 in the same manner as described with respect to arm 31 of the first embodiment. The upper end of arm 68 is also pivotally connected to a mounting block 71 but in this second embodiment, mounting block 71 is located within the slot 65 formed in support member 62 rather than in presser 66. Likewise, the upper end of link 69 is pivotally mounted to arm 68 at the midpoint between the upper and lower pivotal connections of arm 68, and the lower end of link 69 is pivotally mounted to a mounting block 72 fixed within presser 66 rather than within support member 2 as in the first embodiment. A spring 73 acts against slider 70 in the same manner as spring 17 acts against slider 25 in the first embodiment. Thus, spring 73 has one end bearing against slider 70 and its other end bearing against a surface of an abutment member 74, and is supported and guided by a rod 75 extending from abutment member 74. Again, in this second embodiment, abutment member 74 is fixed within presser 66 rather than within base 15 and support member 2 as in the first embodiment. Finally, it should be noted that the distance between the pivotal mounting of the upper end of the link 69 and the pivotal mounting of the lower end of the link 69, and the distance between the pivotal mounting of the upper end of the link 69 and the pivotal mounting of the upper end of arm 68, and the distance between the pivotal mounting of the upper end of link 69 and the pivotal mounting of the lower end of arm 68, are all equal. Also, the pivotal mounting of the upper end of link 69 is located in a plane extending through the upper and lower pivotal mountings of arm 68. Thus, presser 66 moves in a vertical plane perpendicular to the horizontal plane defined by upper surface 63 of support member 62, and in particular moves vertically straight up and down and not in an arcuate path.

Figure 7:
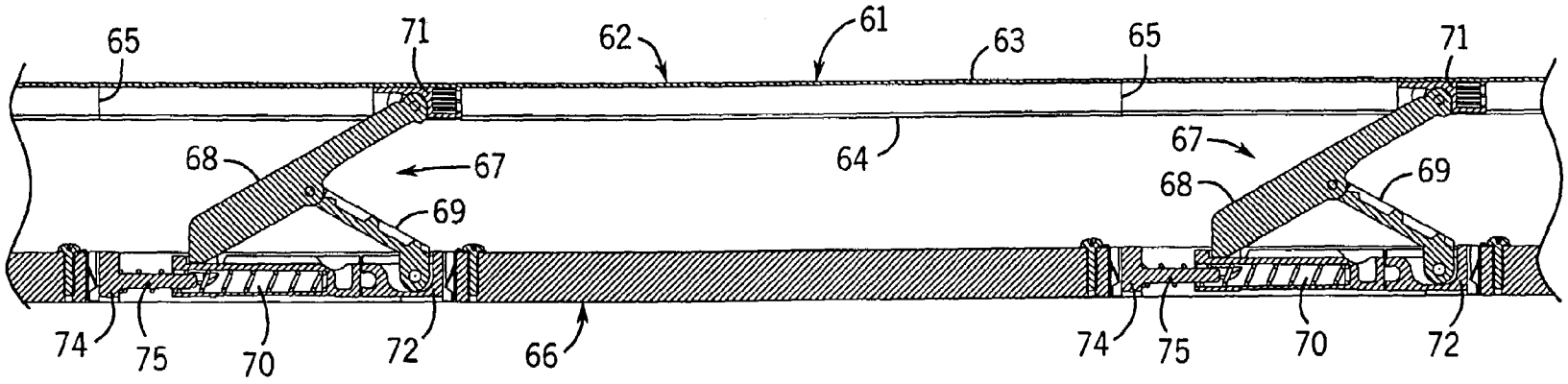
FIG. 7 is a schematic side view in elevation of a second embodiment of the flush mounted presser assembly with a presser shown in its extended position.
Figure 8:
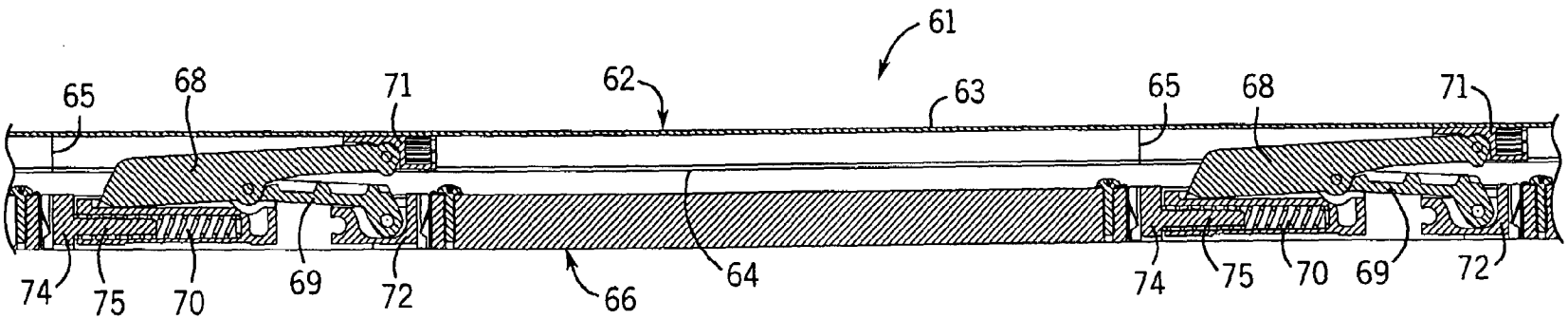
FIG. 8 is a side view in elevation of the presser assembly of FIG. 6 showing the presser in its retracted position.

In operation, FIG. 7 illustrates presser assembly 61 wherein presser 66 is in its initial extended position. As the blanking tool moves downwardly, presser 66 engages the top surface of a sheet of paper material and begins to retract, as previously described, to hold the scrap. Presser 66 is illustrated in FIG. 8 in substantially its fully retracted position wherein arm 68 is disposed within slot 65 formed in support member 62 and the upper surface of presser 66 is closely adjacent to and/or engages lower surface 64 of support member 62. This position is more fully illustrated in FIG. 10 where spring 73 is compressed and slider 70 is spaced from mounting block 72 and engaged against abutment member 74. When presser 66 is in its extended position as shown in FIG. 9, spring 73 is extended and slider 70 is spaced from abutment member 74 and against mounting block 72.

Referring now to FIGS. 11–13, there is illustrated a third embodiment of the present invention. In this third embodiment, the presser assembly designated by the numeral 78 is generally similar to presser assembly 1 except that the presser 79 is a finger-like or spot member rather than an elongate rail as described with respect to the first embodiment. In other words, presser assembly 78 includes a support member (not shown) substantially identical to support member 2 having an upper surface defining a horizontal plane and a lower surface. The support member also includes one or more slots formed therein for receiving base 80 therein. Base 80 is identical to the base 15 of the first embodiment.

In addition, the mounting arrangement for mounting presser 79 to its support member and base 80 is identical to that described with respect to presser assembly 1. In other words, the mounting arrangement includes a linkage assembly 81 having an arm 82, a link 83 and slider (not shown) being slidably received within base 80. Thus, as illustrated in FIGS. 11–13, the upper end of arm 82 is pivotally mounted to a slider within base 80 in the same manner as described with respect to arm 31 of the first embodiment. The lower end of arm 82 is also pivotally connected to spot presser 79. Likewise, the lower end of link 83 is pivotally mounted to arm 82 at the midpoint between the upper and lower pivotal connections of arm 82, and the upper end of link 83 is pivotally mounted by a pin 85 to a mounting block 84 fixed within base 80 in a manner identical to the first embodiment. A spring (not shown) acts against the slider (not shown) in the same manner as spring 17 acts against slider 25 in the first embodiment. Finally, it should be noted that the distance between the pivotal mount of the lower end of the link 83 and the pivotal mounting of the upper end of the link 83, and the distance between the pivotal mounting of the lower end of the link 83 and the pivotal mounting of the upper end of arm 82, and the distance between the pivotal mounting of the lower end of link 83 and the pivotal mounting of the lower end of arm 82, are all equal. Also, the pivotal mounting of the lower end of link 83 is located in a plane extending through the upper and lower pivotal mountings of arm 82. Thus, presser 79 moves in a vertical plane perpendicular to the horizontal plane defined by the upper surface of the support member, and in particular moves vertically straight up and down and not in an arcuate path.

Presser 79 in this third embodiment is referred to as a finger-like member or spot member because it is used to hold scrap portions of relatively small dimensions. As illustrated, presser 79 is pivotally mounted to the lower end of arm 82 by a pin 86 which is disposed within a bore 87 formed through body 88 thereof. Body 88 is composed of rubber or foamed polyurethane and is a substantially solid cylinder in shape. Body 88 extends vertically in a plane perpendicular to the horizontal plane defined by the support member or board, and defines an upper surface 89 and a lower sheet-engaging flat surface 90. A U-shaped spring member 91 is formed integrally with body 88 and projects rearwardly therefrom at an upward angle of about 60°. Spring member 91 engages the underside of arm 82 and biases surface 90 into a substantially horizontal orientation so that it engages the upper surface of the sheet of paper material without any substantially lateral forces that might cause the sheet to move laterally or buckle.

In operation, FIGS. 11–13 illustrate presser assembly 78 wherein presser 79 is in its initial extended position. As the blanking tool moves downwardly, presser 79 engages the top surface of a sheet of paper material and retracts, as previously described, to hold the scrap. The pushers then push the blanks from the sheet, and thereafter the tool then moves back upwardly to its initial starting position where presser 79 is once again in its fully extended position.

Figure 14:
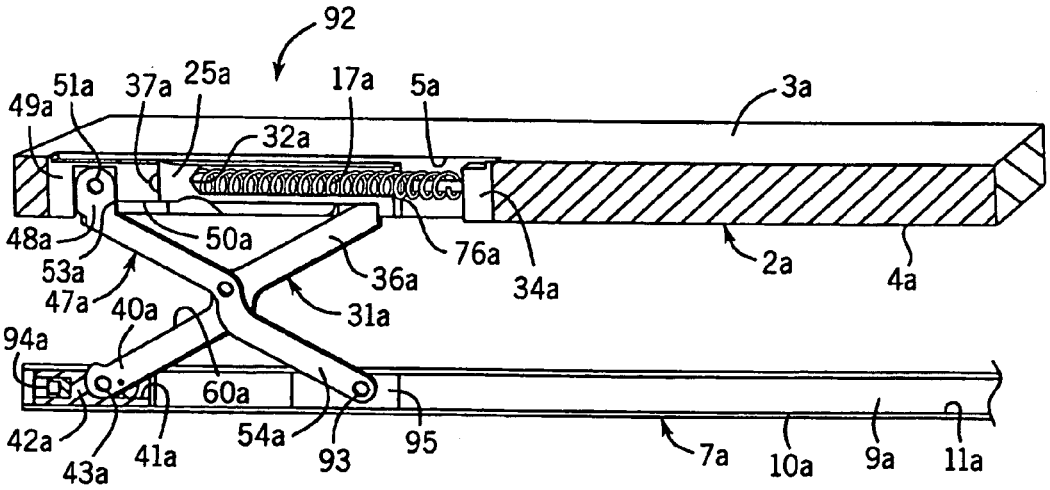
FIG. 14 is a fragmentary view similar to FIG. 2 of a fourth embodiment of the flush mounted presser assembly illustrating a scissor-like linkage assembly.

Referring now to FIG. 14, there is illustrated a fourth embodiment of the flush presser assembly of the present invention. In this fourth embodiment, the presser assembly designated by the numeral 92 is generally similar to presser assembly 1, and thus like numerals are used in FIG. 14 for like components except as hereinafter provided. However, linkage assembly 16*a* includes a link 47*a* extending completely between and interconnecting support 2*a* and presser 7*a* to provide a scissor-like action. Link 47*a* has an upper end 48*a* pivotally mounted to support 2*a* in the same manner as link 47 of the first embodiment, and a lower end 54*a* that pivots and slides horizontally within presser 7*a* as presser 7*a* extends and retracts. As illustrated, the lower end of link 47*a* includes a pin 93 which is pivotally received within a mounting block 95 located in presser 7*a*. Mounting block 95 is preferably composed of a self-lubricating plastic material and reciprocally slides within channel 11*a* as presser 7*a* moves between its extended and retracted positions. Link 47*a* is also pivotally mounted via pin 57*a* to arm 31*a* at the midpoint between the upper and lower pivot mountings of arm 31*a*, and at its own midpoint to insure presser 7*a* moves vertically as it extends and retracts. As illustrated, links 47*a* and 31*a* are also S-shaped which enables them to collapse or next together with presser 7*a* is in its fully retracted position.

Figure 15:
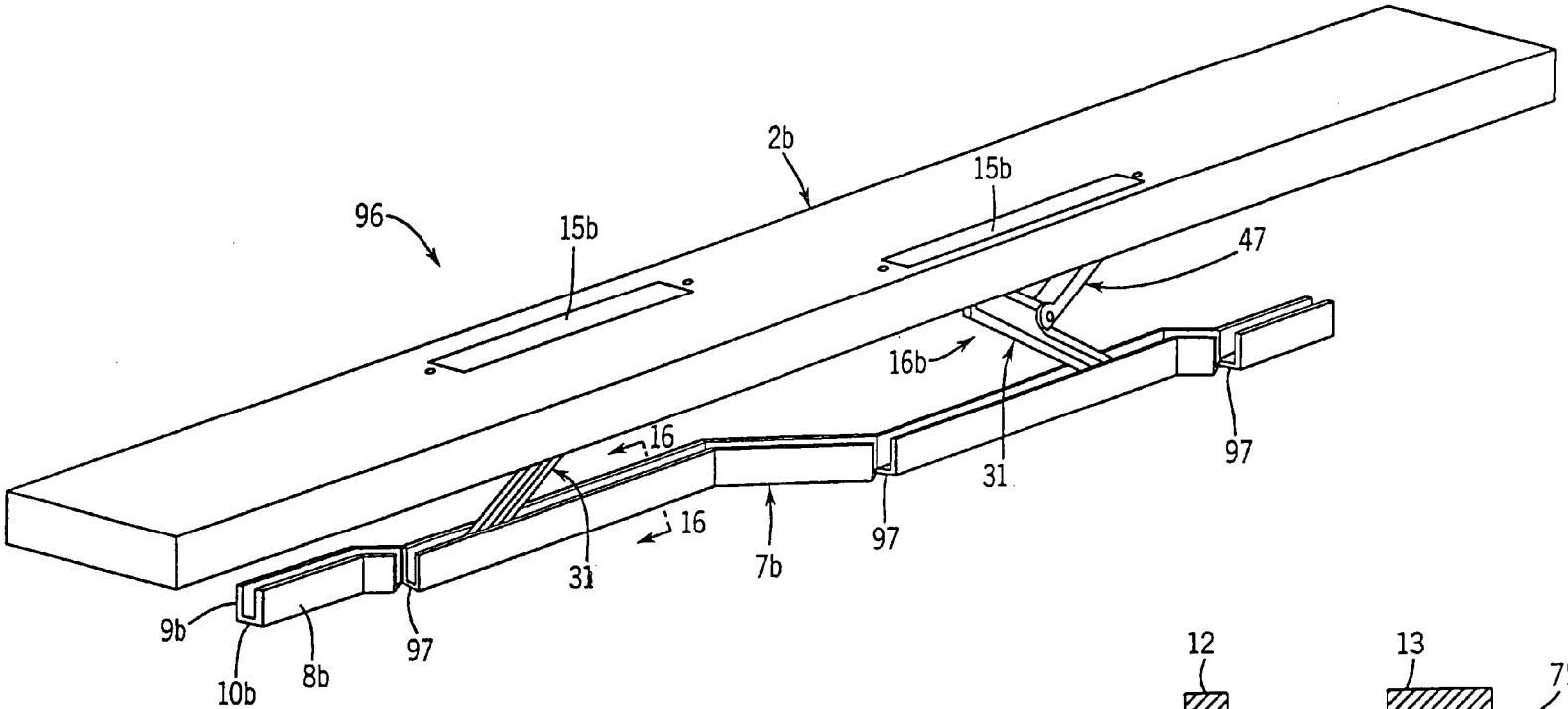
FIG. 15 is a perspective view of a fifth embodiment of the flush mounted presser assembly illustrating a bent presser.
Figure 16:
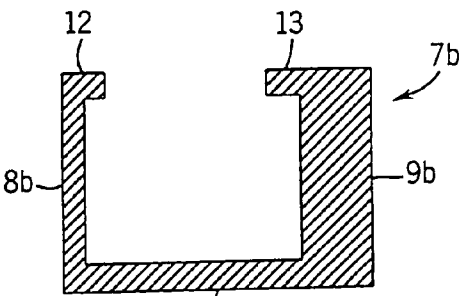
FIG. 16 is a cross-sectional view of the bent presser of FIG. 15 taken along the plane of the line 16—16 in FIG. 15.

Referring now to FIG. 15, there is illustrated a fifth embodiment of the flush mounted presser assembly of the present invention. In this fifth embodiment, the presser assembly designated by the numeral 96 is generally similar to presser assembly 1, and thus like numerals are used in FIG. 15 for like components except as hereinafter provided. However, linkage assemblies 16*b* are located in a staggered orientation on support 2*b* rather than the in-line orientation illustrated in FIGS. 1–5. Also, presser 7*b* is formed of a bendable construction so that it can be utilized when unique or custom presser shapes are desired which may require presser 7*b* to have numerous bends at different acute angles formed along its length to form bent segments along its length. In order to accomplish this, FIG. 16 illustrates that presser 7*b* has a sidewall 18*b* which is much thinner than sidewall 9*b*. In fact, sidewall 8*b* preferably has a thickness of 0.094 inches which is about ⅓ the preferred thickness of 0.14 inches for sidewall 9*b*, and about the same as the preferred thickness of 0.05 inches for bottom wall 10*b*. This reduced thickness permits walls 8*b* and 10*b* to be cut through more readily at the point of the desired bend location, as designated by the numeral 97, to enable presser 7*b* to be bent to the desired angle.

It should further be noted that the interconnections between the support member and presser provided by the linkage assemblies illustrated and described herein could be reversed, and the linkage assemblies would still function properly. Thus, mirror images of the linkage assemblies illustrated can be considered equivalent to those linkage assemblies illustrated and described herein.

I claim:

1. A flush-mounted presser assembly for a die cutting machine, comprising:

a support member having an upper surface which defines a substantially horizontal plane;

a presser movable vertically in a plane perpendicular to said horizontal plane between a first extended position spaced from said support member beneath said horizontal plane and a second retracted position beneath said horizontal plane; and mounting means for mounting said presser to said support member, said mounting means disposed flush with or below said horizontal plane so that said mounting means does not extend above said horizontal plane and including:

a base mounted on said support;

a linkage assembly interconnecting said base and presser, said linkage assembly including:

an arm interconnecting said base and presser and having an upper end mounted to said base that simultaneously pivots and moves horizontally with respect to said support as said presser moves between said extended and retracted positions and a lower end pivotally mounted to said presser;

a link interconnecting said base and arm and having an upper end pivotally mounted to said base and a lower end pivotally mounted to said arm; and a slider mounted for horizontal sliding movement on said base, and the upper end of said arm is pivotally mounted to said slider;

biasing means for biasing said linkage assembly and presser toward said first extended position.

2. The presser assembly of claim 1, wherein said presser comprises a rail member.

3. The presser assembly of claim 2, wherein said rail member is elongate and extends longitudinally parallel to said horizontal plane.

4. The presser assembly of claim 1, wherein said base includes a longitudinally extending and downwardly opening channel.

5. The presser assembly of claim 4, wherein said biasing means comprises a spring disposed within said channel.

6. The presser assembly of claim 1, wherein the pivotal mounting of the lower end of said link is located at the midpoint between said upper and lower pivotal mountings of said arm.

7. The presser assembly of claim 6, wherein the pivotal mounting of the lower end of said link is located in a plane extending through the upper and lower pivotal mountings of said arm.

8. The presser assembly of claim 6, wherein the distances between the pivotal mounting of the lower end of said link and (a) the pivotal mounting of the upper end of the said link, and (b) the pivotal mounting of the upper end of said arm, and (c) the pivotal mounting of the lower end of said arm, are all equal.

9. The presser assembly of claim 1 wherein said base includes a longitudinally extending downwardly opening channel, and said slider is disposed in said channel.

10. The presser assembly of claim 9, wherein said biasing means comprises a spring disposed within said channel acting against said slider.

11. The presser assembly of claim 1 wherein said mounting means includes a linkage assembly having only a single pivot connection interconnecting said linkage assembly and said presser.

12. The presser assembly of claim 1 wherein said mounting means includes a linkage assembly having two pivot connections interconnecting said linkage assembly and said support member.

13. The presser assembly of claim 3 wherein said rail member extends longitudinally along a straight line.

14. A presser assembly for a die cutting machine, comprising:

a housing extending along a first horizontal axis;

a presser extending along a second horizontal axis generally parallel to the first axis and being positioned beneath the housing, the presser being movable between a retracted position and an extended position; and linkage for interconnecting the housing and the presser, and for preventing horizontal movement of the presser as the presser moves between the retracted position and the extended position, the linkage including a base operatively connected to the housing, an arm interconnecting the base and presser, and a biasing structure including a spring extending along a third axis parallel to first and second axes for resiliently biasing the linkage arm and presser downwardly toward said extended position.

15. The presser assembly of claim 14, wherein said presser comprises a rail member.

16. The presser assembly of claim 14, wherein the housing includes a channel and wherein the spring is disposed within the channel in the housing.

17. A presser assembly for a die cutting machine, comprising:

a housing extending along a first horizontal axis;

a presser extending along a second horizontal axis generally parallel to the first axis and being positioned beneath the housing, the presser comprising a rail member and being movable between a retracted position and an extended position; and linkage for interconnecting the housing and the presser, and for preventing horizontal movement of the presser as the presser moves between the retracted position and the extended position, the linkage including a base operatively connected to the housing, an arm interconnecting the base and presser, a biasing structure for resiliently biasing the linkage arm and presser downwardly toward said extended position; and a link interconnecting the base and the arm and having an upper end pivotally mounted to the base and a lower end pivotally mounted to the arm.

18. The presser assembly of claim 17, wherein the pivotal mounting of the lower end of the link is located at the midpoint between the upper and lower pivotal mountings of the arm.

19. A presser assembly for a die cutting machine, comprising:

a housing extending along a first horizontal axis, the housing including a longitudinally extending and downwardly opening channel;

a presser extending along a second horizontal axis generally parallel to the first axis and being positioned beneath the housing, the presser comprising a rail member and being movable between a retracted position and an extended position;

linkage for interconnecting the housing and the presser and for preventing horizontal movement of the presser as the presser moves between the retracted position and the extended position, the linkage having first and second ends and including a base operatively connected to the housing and an arm interconnecting the base and presser, and a spring engaging one of the first and second ends of the linkage for resiliently biasing the linkage arm and presser downwardly toward said extended position.

20. The presser assembly of claim 19 wherein the spring is disposed with the channel in the housing.

* * * * *